US005921305A

United States Patent [19]

Grüdl

[11] Patent Number: 5,921,305

[45] Date of Patent: Jul. 13, 1999

[54] EXTENSION LIMITER FOR AWNINGS

[75] Inventor: Josef Grüdl, Löchgau, Germany

[73] Assignee: Gerhard Geiger GmbH & Co., Bietigheim-Bissingen, Germany

[21] Appl. No.: 08/849,143

[22] PCT Filed: Mar. 5, 1996

[86] PCT No.: PCT/EP96/00913

§ 371 Date: Jul. 28, 1997

§ 102(e) Date: Jul. 28, 1997

[87] PCT Pub. No.: WO97/12105

PCT Pub. Date: Apr. 3, 1997

[30] Foreign Application Priority Data

Sep. 28, 1995 [DE] Germany ..... 195 36 055

[51] Int. Cl.[6] ..... E04F 10/06

[52] U.S. Cl. ..... 160/66; 160/302; 135/88.1; 192/46

[58] Field of Search ..... 160/66, 70, 79, 160/295, 298, 302, 191, 192; 192/46, 139, 143; 135/88.1, 88.11, 88.12

[56] References Cited

U.S. PATENT DOCUMENTS

| | | | |
|---|---|---|---|
| 1,678,790 | 7/1928 | Salesse | 160/295 |
| 1,725,285 | 8/1929 | Lalonde | 160/295 |
| 2,020,595 | 11/1935 | Weber | 160/295 |
| 2,505,416 | 4/1950 | Mahaffey | 160/66 X |
| 5,289,864 | 3/1994 | Bouchier | 160/188 |

FOREIGN PATENT DOCUMENTS

| | | |
|---|---|---|
| 2732013 | 2/1979 | Germany . |
| 2823134 | 11/1979 | Germany . |
| 3240495 | 5/1984 | Germany . |
| 4014962 | 7/1991 | Germany . |

*Primary Examiner*—Blair M. Johnson
*Attorney, Agent, or Firm*—Pauley Petersen Kinne & Fejer

[57] ABSTRACT

An extension limiter for awnings with a roller tube which co-operates with a drive, with an awning fabric and extension arms that exert a force on the awning fabric sufficient for unwinding. The extension limiter is adjustable and can be set.

15 Claims, 3 Drawing Sheets

EXTENSION LIMITER FOR AWNINGS

BACKGROUND OF THE INVENTION

1. Field of the Invention

This invention relates to an extension limiter for awnings, the extension limiter having a driven roller tube and extension arms that exert a force sufficient to unwind an awning fabric.

2. Description of Prior Art

An awning of this type is known from German Patent Reference DE-C1-4014962. Such awning has a braking device which is formed by at least one braking spring in the form of a helical spring, which is located between the driven gear wheel of the drive and a piece rigidly connected to the drive housing, and which is held by one angled end in a groove, located in a hub rigidly connected to the gear wheel which carriers a roller tube. This braking device simultaneously prevents independent and involuntary unwinding of the awning fabric and prevents vibrations of the roller tube during specific operating positions of the extension arms.

A disadvantage of this known awning is that when the drive is further rotated in the unwinding direction in the case where the desired unwinding position of the awning fabric is reached, additional awning fabric is unwound, so that the awning fabric is no longer tightly stretched, and the wind can blow up the awning fabric like a balloon and tear the awning fabric.

SUMMARY OF THE INVENTION

One object of this invention is to provide an awning of the type already mentioned, in which further unwinding of awning fabric is prevented after the desired unwinding position of the awning fabric is reached.

The extension limiter of this invention may be adjusted with high precision, so that the extension limiter engages at practically the same time as the desired unwinding position of the awning fabric is reached. The extension limiter is thus adjusted in such a way that first, the awning fabric is unwound until the desired unwinding position is reached, in which the awning fabric is still under tension, and the extension arms reach a maximum extended position. Thereafter the extension limiter is set in such a way that further rotation of the roller tube is no longer possible, so that even upon further actuation of the crank rod, the tension of the awning fabric is prevented from the slackening. With respect to the drive, the extension limiter is preferably located at the opposite end of the roller tube and is rotatable about the axis of the winding tube and can be set.

As rotation of the extension limiter is continuous, the desired operational position of the extension limiter can be set with absolute precision. In addition, the drive is released from load by the spatial separation of the extension limiter from the drive.

In a simple embodiment of this invention, the locking device has a spindle, which is releasably attached by means of a pin portion in the bearing plate of the thrust bearing, and a threaded portion projecting into the roller tube. A nut runs on the treaded portion. The nut is non-rotatably and axially movably mounted with a peripheral surface in a bearing cup supporting the roller tube.

The desired unwinding position can be better set because the pin portion of the spindle has on its end face means for rotation in a bore of the bearing plate. The bearing plate has a slot leading to the bore, which can be narrowed by means of a screw, in order to clamp the pin portion.

In order to protect the running nut from possible jamming, in another embodiment of this invention the spindle has a collar with at least one stop, and the running nut has at least one stop, which are capable of abutting against the spindle stops.

According to another preferred embodiment of this invention, a locking device co-operates with a freewheel device, which acts between the drive and the roller tube in such a way that the freewheel device comes into the freewheel condition after the desired unwinding position is reached. In this way the running nut is not stressed by pressure generated upon further rotation of the drive after the desired unwinding position is reached. Therefore the running nut can advantageously be made of plastics.

BRIEF DESCRIPTION OF THE DRAWINGS

This invention will now be described in more detail with reference to an embodiment wherein the drawings show.

DESCRIPTION OF PREFERRED EMBODIMENTS

Figure 1:
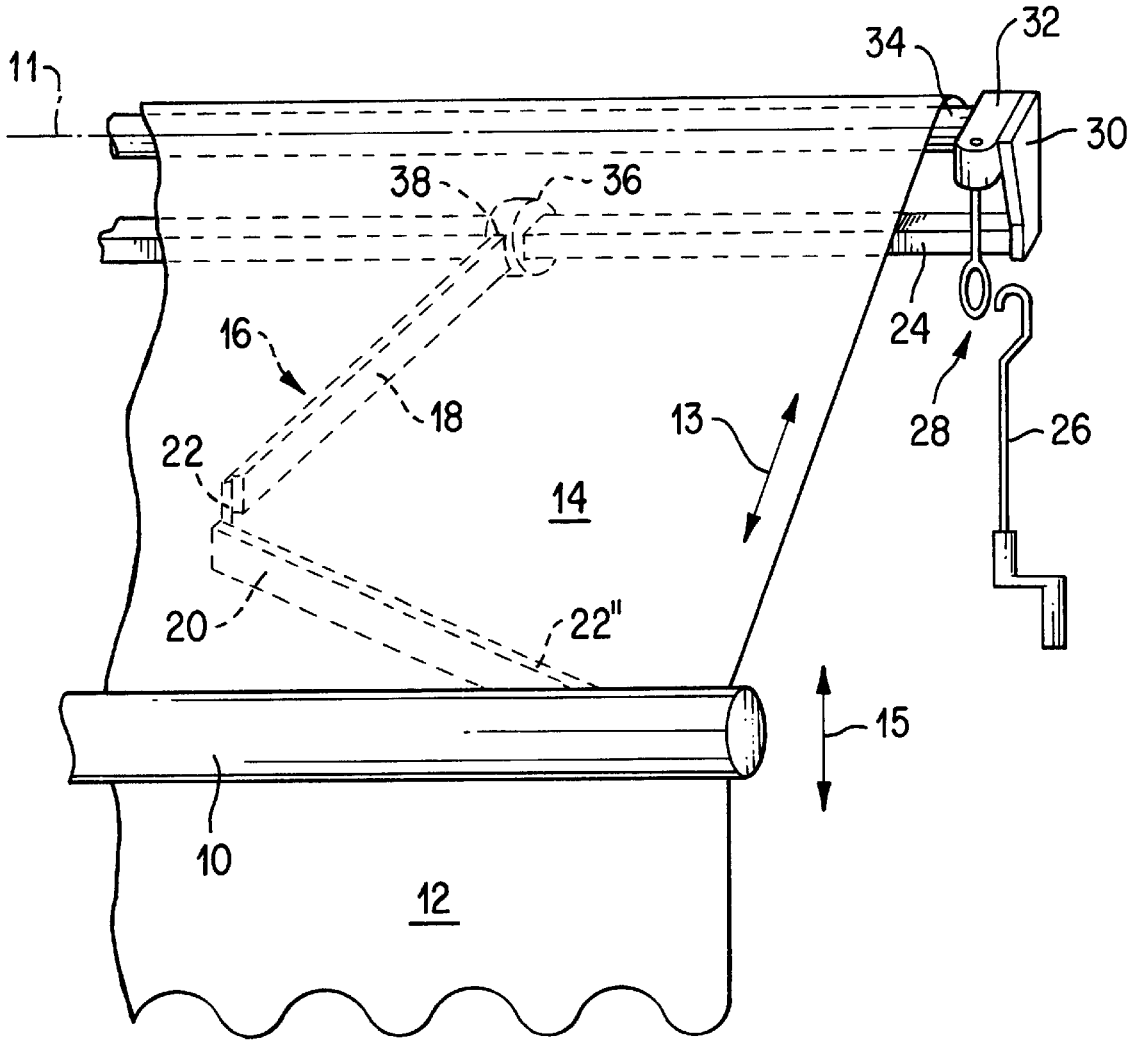
FIG. 1: a portion of an awning in a view obliquely from above.
Figure 2:
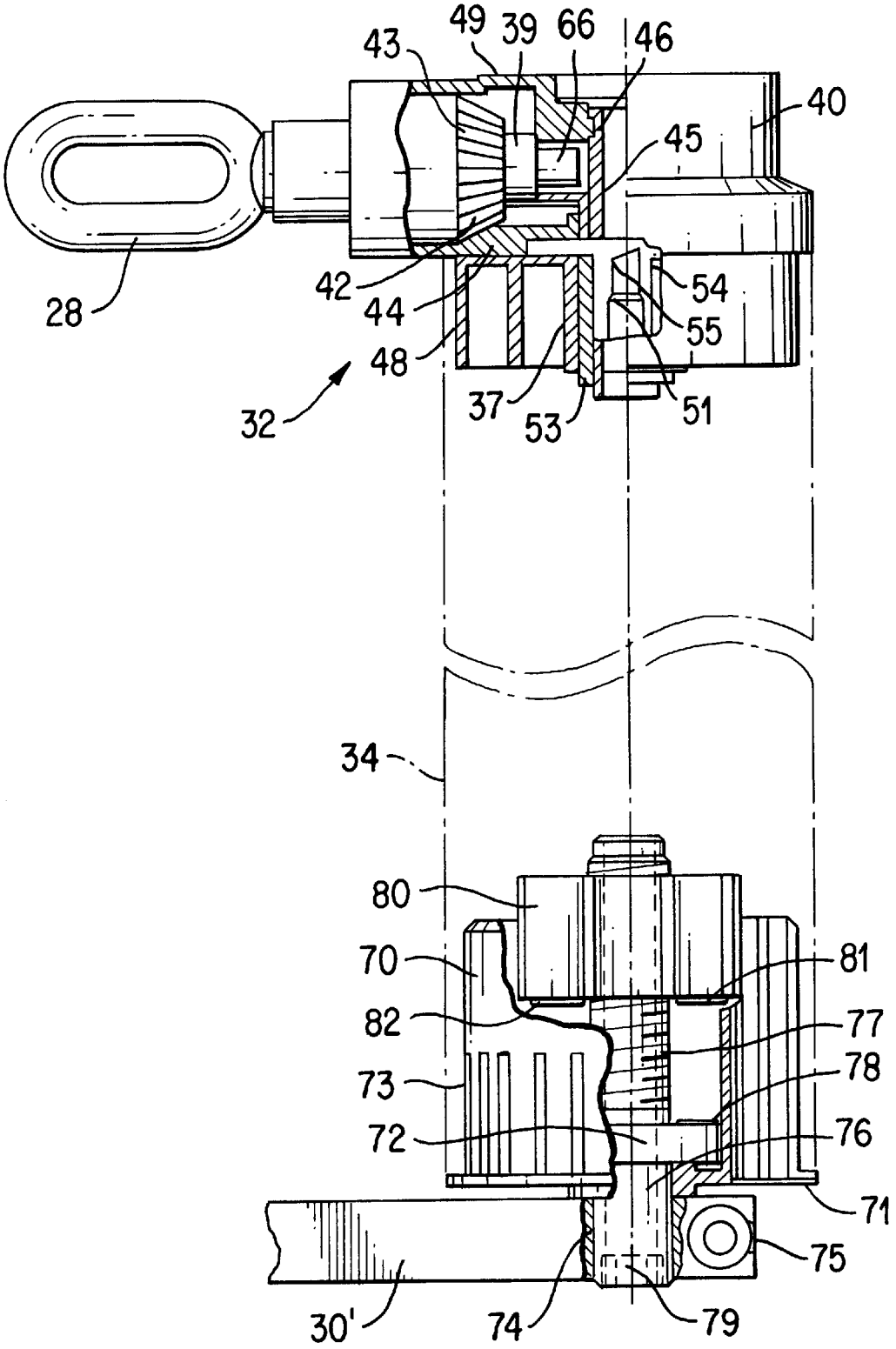
FIG. 2: a side elevation of a bearing having a drive, for the roller tube and a thrust bearing for the roller tube with an unwinding stop device, the bearings shown in partial section.

The awning shown in FIG. 1 has a support arrangement to be attached to a house wall or the like, and has a roller tube 34 mounted to rotate in bearing plates 30, 30', as shown in FIGS. 1 and 2. The roller tube 34 is movable by means of a drive 32 and an engageable or disengageable crank rod 26, which may be engaged in an actuating eye 28. Secured to a support tube 24 located between the bearing plates 30, 30' and two extension arms of which only one, the extension arm 16, is shown.

The extension arm 16 comprises two legs 18, 20 flexibly interconnected by means of a joint 22. The leg 18 is rotatably secured on a portion 36 connected to the support tube 24 by means of a joint 38, and the leg 20 is rotatably secured on a down tube 10 tensioning the awing material 14, by means of a joint 22. The down tube 10 can also carry a free-hanging blind portion 12. The joints 22, 22', 38 ensure that the extension arm 16 folds within one plane. The legs 18, 20 are in the form of tubes. Located in a way not shown in the interior of the tubular leg 20 is a traction spring, which is secured at one end on the joint 22' and at the other end via a cable not shown extending through the tubular leg 18, to the joint 38. This traction spring is permanently tensioned in such a way that it acts in the direction of unfolding the legs 18, 20. When the operating eye 28 is rotated by means of the crank rod 26, the down tube 10 moves in the direction of the double arrow 13. The portion 36 can be in the form of a device for altering inclination, upon operation of which the down tube 10 is movable in the direction of the double arrow 15.

The thrust bearing not visible in FIG. 1 for the roller tube 34 is shown in FIG. 2. The thrust bearing comprises a reinforced bearing cup 70, which is mounted to rotate within a central opening 71 for a pin portion 76 of a spindle 72. Uniformly distributed on the circumference of the cup 70 are axially parallel ribs 73, which engage into axially parallel grooves, not shown in the drawings, on the inner circumference of the roller tube 34, which engage the ribs 73, so that the cup 70 is non-rotatably connected to the roller tube 34. The pin portion 76 may be non-rotatably attached in a bore 74 in the bearing plate 30'. For this purpose the bearing plate 30' has a slot extending vertically above the pin portion 76, not shown in the drawings, which may be narrowed by means of a screw 75, so that the pin portion 76 may be securely clamped. At the end, the pin portion 76 has a recess 79 into which a key, not shown in the drawings, can be thrust in order to rotate the pin portion 76 and thus the spindle 72. The spindle 72 has a collar with two stops, only one stop 78 being shown, and a threaded portion 77, which runs on a running nut 80 that has an internal thread. On the side facing the stop 78, the running nut has two stops 81, 82, and is radially non-rotatable but axially movably mounted on its external circumference in the cup 70.

Figure 3:
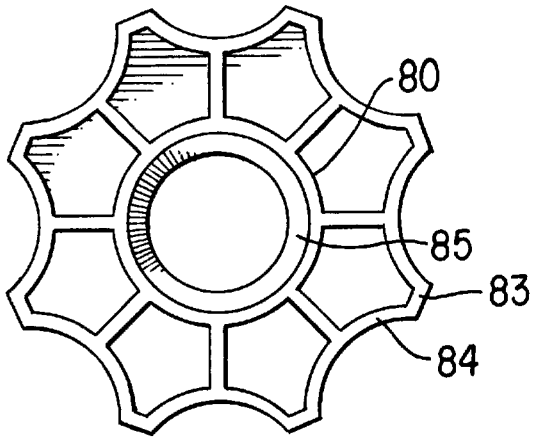
FIG. 3: a rear view of a running nut non-rotatably connected to the roller tube.
Figure 4:
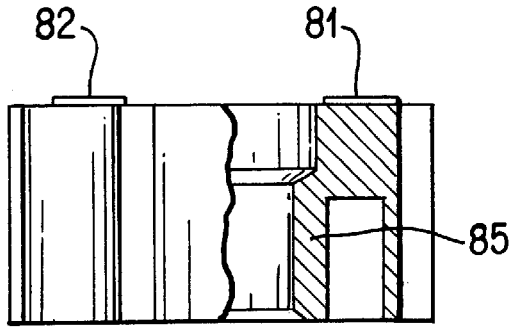
FIG. 4: a side elevation of the running nut shown in FIG. 3 in a partial section of the running nut along the line A—A as shown in FIG. 3.
Figure 5:
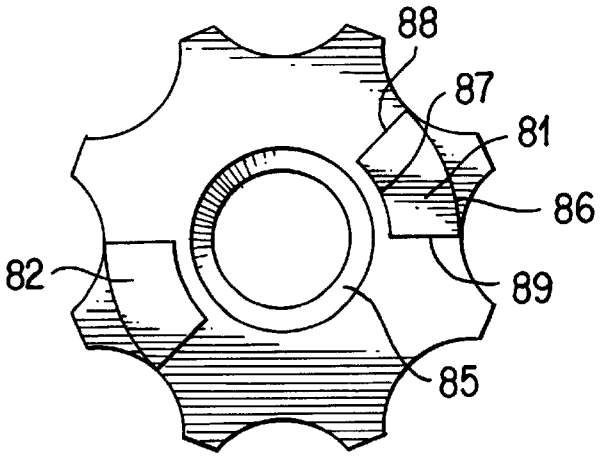
FIG. 5: a plan view of an end face of a running nut as shown in FIG. 3.

The construction of the running nut 80 is seen in more detail in FIGS. 3 to 5. As the rear view of the running nut 80 in FIG. 3 shows, the running nut 80 has an outer periphery which is roughly octagonal in cross-section, with inwardly bent peripheral sides 84 between the corners, whose centres are braced with a threaded ring 85 carrying the internal thread, so that eight chambers are formed. The running nut 80 nevertheless remains stable. The end side of the running nut 80 carries the two stops 81, 82. As shown at the point of the stop 81, this stop has the surface shape of an arc segment, defined by an outer edge 86, an inner edge 87 and two radial side edges 88, 89. Thus the outer edge 86 forms an arc segment of a circle with a larger radius, while the inner edge 87 represents an arc segment of a circle with a smaller radius. From side edge 88, the surface inclines uniformly upwards as far as the side edge 89. The same applies to the stop 82. The running nut 80 is preferably made of plastics or metal.

The cup 70 has an internal shape adapted to the peripheral sides 84, and accordingly has two to eight round internal longitudinal ribs, upon which the running nut 80 can slide axially. The stops 78 of the spindle 72 correspond to the stops 81, 82, so that the edges 89 can abut against corresponding edges of the stops 78.

FIG. 2 shows the drive for the roller tube 34. This drive can be advantageously used in this invention. However, other types of drives may also be used. The drive comprises a casing 40 with two gear wheels 43, 44, which form a pair of bevel gears. The axis of rotation of the gear wheels 43, 44 are located at right angles to one another, and teeth 42, 49 of the gear wheels mesh in one another. The gear wheel 44 is mounted to rotate on a section 34 of the casing 40 in the shape of the periphery of a cylinder. A shaft 39 of the gear wheel 43 is mounted to rotate with its end 66 in the casing 40. A cylindrical tube 46 is located centrally in an interior of the section 45 and in a cylindrical recess of the casing 40 in extension of the section 45, and is non-rotatably connected with the casing 40. This cylindrical tube 46 serves as a bearing for a hub-shaped portion 37 of the gear wheel 44. In turn mounted to rotate on this portion 37 is an adapter 48, which is in the shape of a cylindrical drum open on one side, upon which the roller tube 34 is non-rotatably secured. The adapter 48 and the portion 37 of the gear wheel 44 are secured against horizontal displacement by means of a securing member 51. A rib, not shown in the drawings, in the interior of the roller tube 34 engages in a longitudinal groove, not shown in the drawings, on the outer periphery of the adapter 48, so that the adapter 48 together with the roller tube 34 is rotatable on the portion 37. The adapter 48 is an injection-molded plastics part and for reasons of economy of materials has a honeycomb and thus stable structure.

The gear wheel 44 is coupled to the adapter 48 and thus to the roller tube 34 by means of a freewheel device, which is indicated in FIG. 2 by a chamber 53 of the adapter 48. A resilient latch 54 is guided in the chamber 53, and by a recess 55 formed in the gear wheel 44 or a screw, in which the latch 54 can positively engage. The method of operation of the unwinding locking device according to this invention in conjunction with the drive comprising the freewheel device is as follows. Upon unwinding of the awning fabric 14 by means of the crank rod 26, the spring located in the leg 20 spreads the legs 18, 20 apart. The end of the latch 54 thus engages an edge of the recess 55; other latches and other recesses can be provided. No pressure needs be exerted on the crank rod 26, as the tension of the spring located in the leg 20 is sufficient to unwind the awning fabric 14. During this unwinding procedure, the running nut 80 is transported out of the position shown in FIG. 2 on the spindle 72 in the direction of the stops 78. Once the desired unwinding position of the awning fabric 14 is reached, the stops 78, 81, and the two other stops abut one another, so that any further unwinding movement of the roller tube 34 in the same direction is prevented. The tension of the traction spring in the leg 20 ensures that the awning fabric 14 remains tight. If the crank rod 26 were to be further rotated in the direction of unwinding, the latch 54 with its nose disengages from the edge of the recess 55; this latch is applied with its oblique surface against another edge of the recess 55, and is pressed inwards into the chamber 53. This procedure can be repeated at further recesses in the gear wheel 44. Thus the two gear wheels 43, 44 freewheel, while the roller tube 34 is locked by the running nut 80.

During the winding-up procedure, the crank rod 26 is rotated in the opposite direction. In this case the latch 54 engages again with its end in an edge of the recess 55 or another corresponding edge, so that the roller tube 34 is carried along with it. Thus the stops 78, 81 are separated from one another again, and the running nut 80 runs in the direction of the drive.

One important advantage of this invention is that the user can optionally select the desired unwinding position. For this purpose the awning fabric 14 is unwound as far as the desired unwinding position provided. Then the screw 75 is loosened, until the pin portion 76 is rotatable in the bore 71. Then the key is thrust into the recess 79 and the spindle 72 rotated until the running nut 80 abuts with its stop 81 against the stop 78 of the spindle 72. Finally, the screw 75 is again tightened. In order to facilitate setting of the desired unwinding position, the screw 75 can be in the form of a wing nut, and the pin portion 76 can be provided with a fixed crank.

A further advantage of this invention resides in the fact that the running nut 80 is made of plastics and thus can be economically manufactured, because, upon further rotation of the crank rod 26 after reaching the desired unwinding position, the freewheel device 53, 54, 56 prevents possible damage to the stops 81, 82 and to the internal thread of the running nut 80.

A further advantage of this invention resides in the fact that possible jamming of the running nut 80 is prevented by providing the stops 78 on the spindle 72 and the stops 81, 82 on the running nut 80.

I claim:

1. In an extension limiter (70, 72, 80) for awnings, having a roller tube (34) which co-operates with a drive (32), an awning fabric (14), and extension arms (16), which exert a force sufficient for unwinding on the awning fabric (14), the improvement comprising:

the extension limiter (70, 72, 80) being adjustable and settable and comprising a spindle (72) having a collar comprising at least one collar stop (78) and a running nut (80) having at least one nut stop (81, 82) which can abut the stop (78); wherein the at least one nut stop (81, 82) is each formed by an oblique surface which inclines upward from one radial side edge (88) of the at least one nut stop (81, 82) to an other radial side edge (89) of the at least one nut stop (81, 82).

2. In an extension limiter according to claim 1, wherein the extension limiter (70, 72, 80) is a locking device.

3. In an extension limiter according to claim 2, wherein the extension limiter (70, 72, 80) is located on one end of the roller tube (34), and the drive (32) is positioned at an other end of the roller tube (34).

4. In an extension limiter according to claim 3, wherein the locking device comprises the spindle (72) releasably secured with a pin portion (76) in a bearing plate (30') of a thrust bearing, a threaded portion (77) of the spindle (72) projecting into the roller tube (34), and the running nut (80) is engageable on the threaded portion (77) and non-rotatably and axially displaceably mounted with a peripheral surface of the running nut (80) in a bearing cup (70) carrying the roller tube (34).

5. In an extension limiter according to claim 4, wherein the bearing plate (30') has a bore (71), the pin portion (76) of the spindle (72) has on an end surface a means (79) for rotation in the bore 71, the bearing plate (30') has a slot leading to the bore (71), and a width of the slot is adjustable by a screw (75) that clamps the pin portion (76).

6. In an extension limiter according to claim 1, wherein the running nut (80) has an outer periphery roughly octagonal in cross-section, with a plurality of peripheral sides (84) bent inwards between corners, and having centers that are braced by a threaded ring (85) having an internal thread, forming a plurality of chambers which are closed towards an end side of the running nut (80).

7. In an extension limiter according to claim 6, wherein the running nut (80) is made of a plastic material.

8. In an extension limiter according to claim 7, wherein the locking device co-operates with a freewheel device (53, 54, 55).

9. In an extension limiter according to claim 8, wherein the freewheel device (53, 54, 55) is between the drive (32) and the roller tube (34), and passes into a freewheel condition after a desired unwinding position is reached.

10. In an extension limiter according to claim 8, wherein the freewheel device (53, 54, 55) is a part of the drive (32), and is in operative connection with a drive shaft.

11. In an extension limiter according to claim 8, wherein the freewheel device (53, 54, 55) comprises a crank rod which co-operates with the drive (32).

12. In an extension limiter according to claim 1, wherein the extension limiter (70, 72, 80) is located on one end of the roller tube (34), and the drive (32) is positioned at an other end of the roller tube (34).

13. In an extension limiter according to claim 1, wherein the extension limiter (70, 72, 80) is a locking device that comprises the spindle (72) releasably secured with a pin portion (76) in a bearing plate (30') of a thrust bearing, a threaded portion (77) of the spindle (72) projecting into the roller tube (34), and the running nut (80) is engageable on the threaded portion (77) and non-rotatably and axially displaceably mounted with a peripheral surface of the running nut (80) in a bearing cup (70) carrying the roller tube (34).

14. In an extension limiter according to claim 4, wherein the running nut (80) has an outer periphery roughly octagonal in cross-section, with a plurality of peripheral sides (84) bent inwards between corners, and having centers that are braced by a threaded ring (85) having an internal thread, forming a plurality of chambers which are closed towards an end side of the running nut (80).

15. In an extension limiter according to claim 4, wherein the running nut (80) is made of a plastic material.

* * * * *